United States Patent [19]

Hayashi et al.

[11] Patent Number: 4,649,869

[45] Date of Patent: Mar. 17, 1987

[54] COOLING SYSTEM FOR AUTOMOTIVE ENGINE OR THE LIKE

[75] Inventors: Yoshimasa Hayashi, Kamakura; Tsuyoshi Tamazawa, Yokohama, both of Japan

[73] Assignee: Nissan Motor Co., Ltd., Yokohama, Japan

[21] Appl. No.: 657,956

[22] Filed: Oct. 5, 1984

[30] Foreign Application Priority Data

Oct. 28, 1983 [JP] Japan ..... 58-202179

[51] Int. Cl.[4] ..... F01P 3/22

[52] U.S. Cl. ..... 123/41.21; 123/41.27; 123/41.44; 123/41.31

[58] Field of Search ..... 123/41.02, 41.06, 41.12, 123/41.2–41.27, 41.44, 41.54, 41.74, 41.82 R, 41.31, 193 CH; 277/235 B

[56] References Cited

U.S. PATENT DOCUMENTS

| | | | |
|---|---|---|---|
| 1,687,679 | 10/1928 | Mallory | 123/41.27 |
| 1,787,562 | 1/1931 | Barlow | 123/41.44 |
| 1,792,520 | 2/1931 | Weinhardt | 123/41.03 |
| 2,083,611 | 6/1937 | Marshall | 62/125 |
| 2,292,946 | 8/1942 | Karig | 123/41.2 |
| 2,420,436 | 5/1947 | Mallory | 123/178 |
| 2,679,241 | 5/1954 | Dickson | 123/193 CH |
| 2,972,341 | 2/1961 | Forst et al. | 123/41.72 |
| 3,430,611 | 3/1969 | Belter | 123/193 CH |
| 3,727,642 | 4/1973 | Holmes | 138/30 |
| 3,809,150 | 5/1974 | Holmes | 123/41.54 |
| 3,843,141 | 10/1974 | Kuhn | 123/193 CH |
| 3,981,279 | 9/1976 | Bubniak et al. | 123/41.14 |
| 4,061,187 | 12/1977 | Rajasekaran et al. | 123/41.54 |
| 4,367,699 | 1/1983 | Evans | 123/41.49 |
| 4,381,736 | 5/1983 | Hirayama | 123/41.44 |

FOREIGN PATENT DOCUMENTS

| | | | |
|---|---|---|---|
| 0059423 | 9/1982 | European Pat. Off. . | |
| 527342 | 5/1931 | Fed. Rep. of Germany . | |
| 736381 | 5/1943 | Fed. Rep. of Germany . | |
| 1082083 | 5/1960 | Fed. Rep. of Germany . | |
| 56-32025 | 4/1981 | Japan | 123/41.21 |
| 56-32026 | 4/1981 | Japan . | |
| 58-5449 | 1/1983 | Japan . | |
| 693873 | 7/1953 | United Kingdom . | |
| 786437 | 11/1957 | United Kingdom . | |
| 911822 | 11/1962 | United Kingdom . | |

*Primary Examiner*—William A. Cuchlinski, Jr.
*Attorney, Agent, or Firm*—Schwartz, Jeffery, Schwaab, Mack, Blumenthal & Evans

[57] ABSTRACT

In order to prevent air leaking into an ICE cooling system wherein the coolant is boiled and condensed in a radiator or condenser in a manner that the rate of condensation can be increased to the point of lowering the pressure within the system to a sub-atmospheric level and thus lower the boiling point of the coolant, special seals are provided between the cylinder head and cylinder block (by way of example) which hermetically seal same against the invasion of contaminating air, while, when the engine is stopped, coolant is admitted to fill the system. To purge any air or like non-condensible which finds its way into the system, coolant is pumped in to overfill same during engine warm up.

18 Claims, 15 Drawing Figures

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein a liquid coolant is boiled to make use of the latent heat of vaporization of the same and the vapor used as a vehicle for removing heat from the engine, and more specifically to such an engine wherein the pressure within the cooling system can be rendered sub-atmospheric in order to lower the boiling point of the coolant and which includes means via which contaminating air can be prevented from leaking into the system under such circumstances.

2. Description of the Prior Art

In currently used "water cooled" internal combustion engines such as shown in FIG. 1, the engine coolant (liquid) is forcefully circulated by a water pump through a circuit including the engine coolant jacket and a radiator (usually fan cooled). This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to achieve this a flow rate of 167 Liter/min (viz., $4000-60\times\frac{1}{4}$) must be produced by the water pump. This of course undesirably consumes a number of horsepower.

With the above type of engine cooling system, the temperature of the coolant is prevented from boiling and maintained within a predetermined narrow temperature range (usually 80 to 90 degrees) irrespective of the load and/or mode of operation of the engine, despite the fact that it is advantageous from the point of fuel economy to raise the temperature of the engine during low-medium load "urban" cruising, to increase the thermal efficiency of the engine, and reduce same during high speed and/or high load (full throttle) modes of operation for engine protection.

Further, with this type of cooling system further problems are encountered when the engine is provided with a turbocharger. Viz., as the temperature of the coolant is maintained at a level which prevents boiling, the amount of heat which can be removed during high load operation is limited so that under full boost supercharging, reduction of the compression ratio and/or retarding of the ignition timing such as shown by I and II in FIG. 2 is normally necessary to suppress knocking and the like. On the other hand, during low load operation the temperature of the engine is maintained at a temperature lower than that required for optimal thermal efficiency whereby the temperature of the exhaust gases used to drive the turbine of the turbocharger, is accordingly lower than optimal thereby lowering the amount of heat energy available for rotating the compressor.

One arrangement which has attempted to overcome the above mentioned problems is disclosed in Japanese Patent Application First Provisional Publication No. Sho 58-5449. This arrangement senses the temperature of the combustion chamber walls and controls an electrically powered water pump in accordance therewith. However, as in the conventional arrangement disclosed hereinbefore, still a large volume of water or like coolant is required and during high load operation the electric pump is continuously energized consuming similar large amounts of energy.

Another arrangement via which the temperature of the engine may be varied in response to load is disclosed in U.S. Pat. No. 2,420,436 issued on May 1947 in the name of Mallory. This document discloses an arrangement wherein the volume of water in the cooling system is increased and decreased in response to engine temperature and load. However, with this arrangement only the water level in the radiator is varied while the water jacket, formed in the cylinder block and cylinder head, remains full under the influence of a water circulation pump. Accordingly, this arrangement has suffered from the drawback that a power consuming water circulation pump is required, the temperature by which the coolant can be increased is limited by the fact that the water is prevented from boiling and in that the notable mass of water increases the weight and warm-up time of the engine.

FIG. 3 shows an arrangement disclosed in Japanese Patent Application Second Provisional Publication No. Sho 57-57608. This arrangement has attempted to vapourize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity. This arrangement has suffered from the drawbacks that the radiator, depending on its position with respect to the engine proper tends to be at least partially filled with liquid coolant. This greatly reduces the surface area via which the gaseous coolant (for example steam) can effectively release its latent heat of vaporization and accordingly condense and thus has lacked any notable improvement in cooling efficiency. Further, with this system the pressure is maintained at atmospheric level in order to maintain the boiling point of the coolant constant and thus lacks any response to changes in engine load and speed. In order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level. A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undissolved air tends to collect in the upper section of the radiator and inhibit the convention-like circulation of the vapor from the cylinder block to the radiator. This of course further deteriorates the performance of the device.

European Patent Application Provisional Publication No. 0,059,423 published on Sept. 8, 1982 discloses another arrangement wherein, liquid coolant in the coolant jacket of the engine, is not circulated therein and permitted to absorb heat to the point of boiling. The gaseous coolant thus generated is adiabatically compressed in a compressor so as to raise the temperature and pressure thereof and introduced into a heat exchanger. After condensing, the coolant is temporarily stored in a reservoir and recycled back into the coolant jacket via a flow control valve.

This arrangement has suffered from the drawback that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms large bubbles of air which cause a kind of "embolism" in the radiator and badly impair the heat exchange ability thereof.

U.S. Pat. No. 4,367,699 issued on Jan. 11, 1983 in the name of Evans (see FIG. 4 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small pump 11.

This arrangement while providing an arrangement via which air can be initially purged from the system tends to, due to the nature of the arrangement which permits said initial non-condensible matter to be purged from the system, suffers from rapid loss of coolant when operated at relatively high altitudes. Further, once the engine cools air is relatively freely admitted back into the system. Moreover, with this system it is impossible to reduce the pressure within the system below atmospheric so as to lower the boiling point of the coolant as under such conditions air is readily inducted into the system. The provision of the separation tank 6 also renders engine layout difficult.

Japanese Patent Application First Provisional Publication No. Sho. 56-32026 (see FIG. 5 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with gaseous coolant during engine operation during which liquid coolant sprayed onto the ceramic layers 12. However, this arrangement has proved totally unsatisfactory in that upon boiling of the liquid coolant absorbed into the ceramic layers the vapor thus produced escaping into the coolant jacket inhibits the penetration of liquid coolant into the layers whereby rapid overheat and thermal damage of the ceramic layers 12 and/or engine soon results. Further, this arrangement is plagued with air contamination and blockages in the radiator similar to the compressor equipped arrangement discussed above.

Another air purge arrangement for a so called "vapor cooled" type engine of the nature disclosed hereinabove in connection with U.S. Pat. No. 4,367,699, is found in U.S. Pat. No. 2,292,946 issued in Aug. 11, 1942 in the name of Karig. This arrangement includes a heat sensitive bulb which is exposed to the interior of the condensor or radiator. The bulb contains a volatile liquid and controls the opening and closing of a diaphragm valve. With this arrangement, upon a sufficiently high temperature prevailing in the condensor, the diaphram valve closes a vent port through which air and the like is discharged during initial warm-up. However, this arrangement aims at maintaining a uniform temperature regardless of variations in the conditions to which the engine is exposed and accordingly lacks any ability to vary the engine temperature in response to changes in engine speed and engine load and in no way seeks to induce conditions which minimize the tendancy for contaminating air to leak back into the system when it cools down after operation.

SUMMARY OF THE INVENTION

It is an object of the present invention to provide a cooling system for an internal combustion engine wherein a liquid coolant is boiled and the vapor used as a heat transfer medium, which can be operated in a manner to lower the pressure within the system to sub-atmospheric levels and which minimizes or obviates the tendency for contaminating air to leak into the system during periods when the pressure in the system is below atmospheric.

It is a further object to provide a system which in addition to minimizing the tendency for air or the like contaminating non-condensible matter to be inducted into the system, further enables the purging of such matter during either or both of cooling and warming-up of the system.

In brief, the above mentioned objects are fullfilled by an arrangement wherein, in order to prevent air leaking into a ICE cooling system in which the coolant is boiled and condensed in a radiator or condenser in a manner that the rate of condensation can be increased to the point of lowering the pressure within the system to a sub-atmospheric level and thus lower the boiling point of the coolant, special seals are provided between the cylinder head and cylinder block (by way of example) which hermetically seal same against the invasion of contaminating air, while, when the engine is stopped, coolant is admitted to fill the system. To purge any air or like non-condensible which finds its way into the system, excess coolant is pumped in to overfill same during engine warm up.

More specifically, the present invention takes the form of an internal combustion engine having a combustion chamber and which features a radiator, a coolant jacket in which coolant is boiled and the vapor produced fed to the radiator, a first sensor for sensing a first engine operation parameter, a device responsive to the first sensor for varying the rate of condensation of the vapor in the radiator, and means for preventing air entering the coolant jacket when sub-atmospheric pressures prevail therein.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of concrete embodiments of the present invention, it is deemed appropriate to discuss the concept on which the present invention is based.

Figure 1:
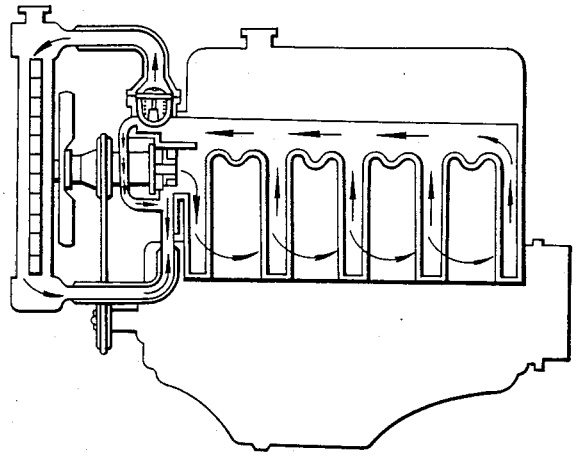
FIG.1 (PRIOR ART)
FIG. 1 is a side sectional elevation of a prior art cooling system.
Figure 2:
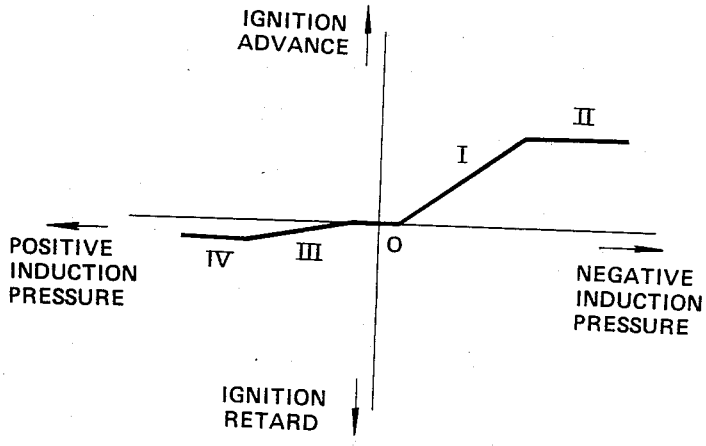
FIG.2 (PRIOR ART)
FIG. 2 is a graph showing, in terms of ignition advance and induction pressure, the ignition settings normally used in turbocharged engines equipped with the FIG. 1 cooling system.
Figure 3:
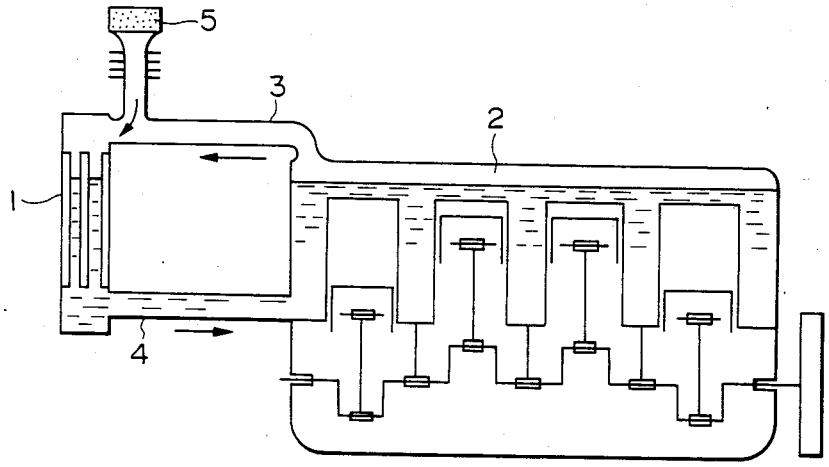
FIG.3 (PRIOR ART)
FIG. 3 is a schematic side elevation of a second prior art cooling system discussed in the opening paragraphs of the instant disclosure.
Figure 4:
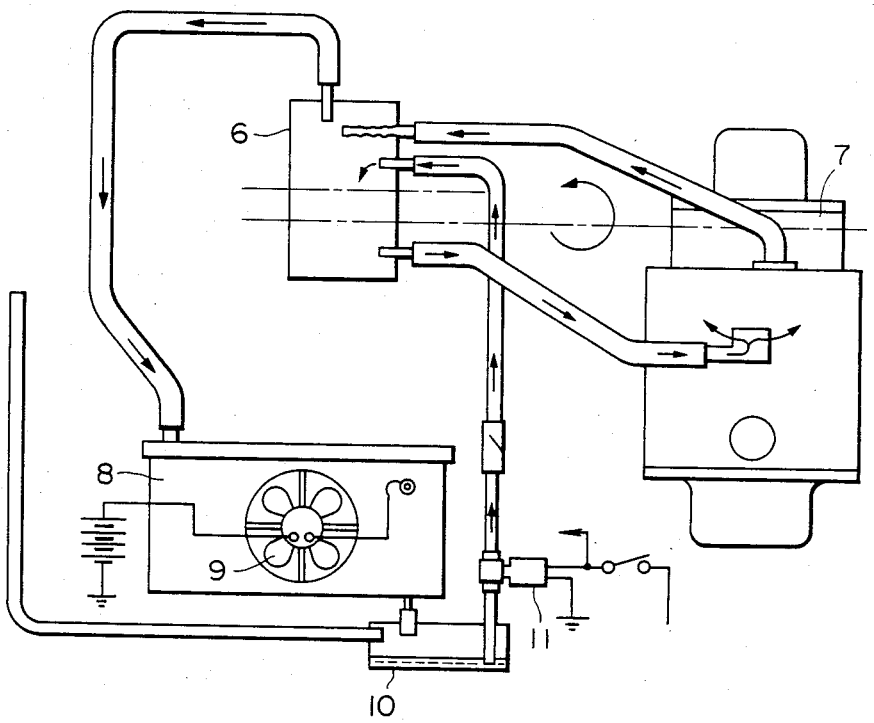
FIG.4 (PRIOR ART)
FIG. 4 is a schematic view of a third prior art arrangement.
Figure 5:
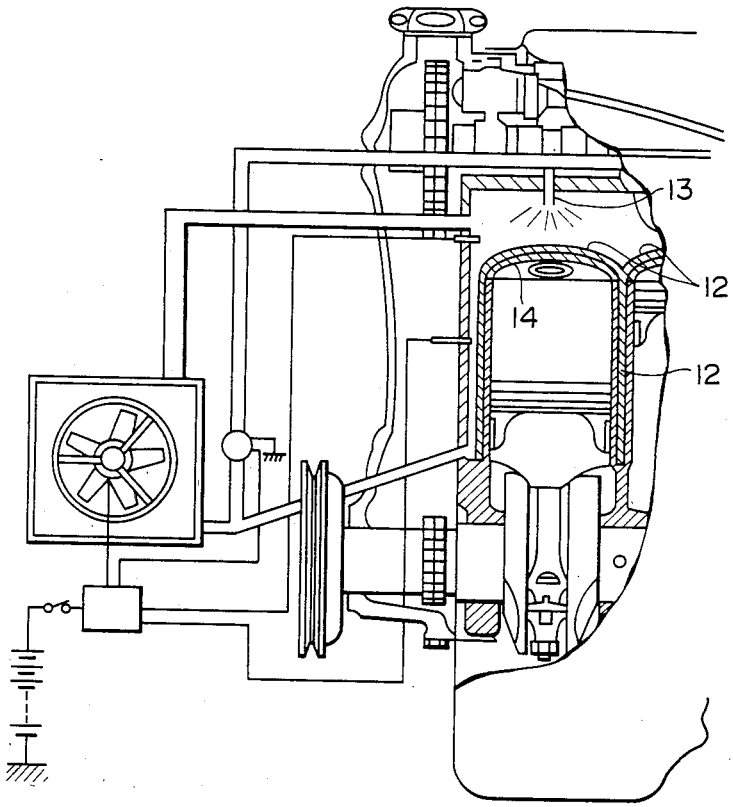
FIG.5 (PRIOR ART)
FIG. 5 is a partially sectioned view of a fourth prior art arrangement discussed briefly in the opening paragraphs of the instant disclosure.
Figure 6:
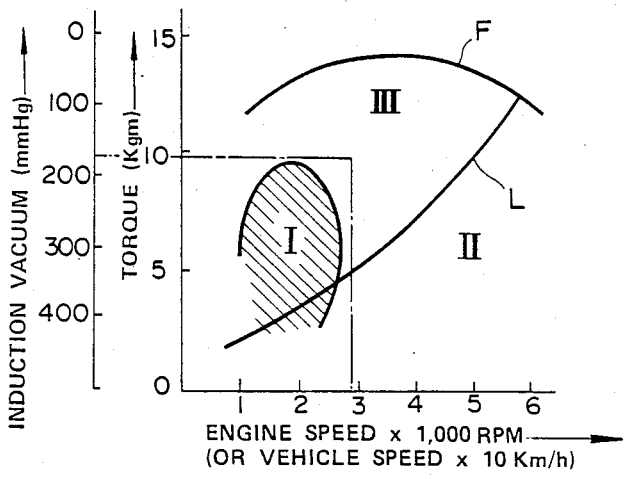
FIG. 6 is a graph showing, in terms of load (torque or induction pressure) and engine speed, the various load zones encountered by internal combustion engines.

FIG. 6 graphically shows in terms of engine torque and engine speed the various load "zones" which are encountered by an automotive vehicle engine. In this graph, the curve F denotes full throttle torque characteristics, trace L denotes the resistance encountered when a vehicle is running on a level surface, and zones I, II and III denote respectively "urban cruising", "high speed cruising" and "high load operation" (such as hillclimbing, towing etc.).

A suitable coolant temperature for zone I is approximately 110° C. while 90°–80° C. for zones II and III. The high temperature during "urban cruising" of course promotes improved fuel economy while the lower temperatures promote improved charging efficiency while simultaneously removing sufficient heat from the engine and associated struture to obviate engine knocking and/or engine damage in the other zones. For operational modes which fall between the aforementioned first, second and third zones, it is possible to maintain the engine coolant temperature at approximately 100° C.

Figure 7:
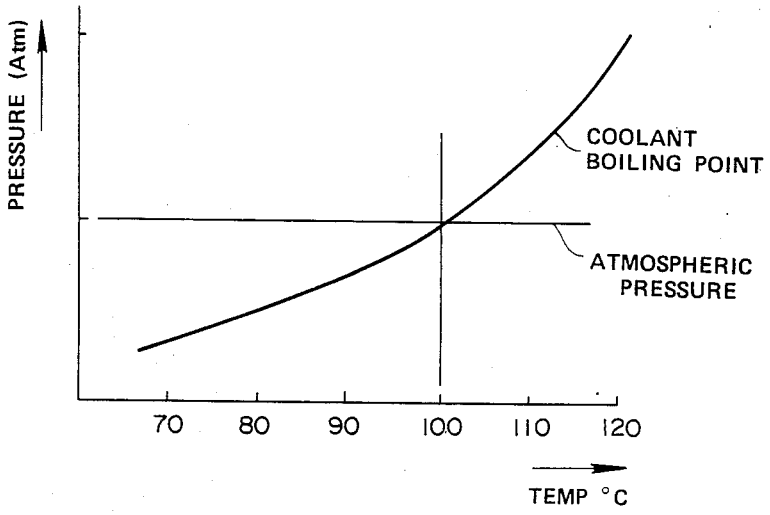
FIG. 7 is a graph showing, in terms of pressure and temperature, the change of boiling point which occurs with change of pressure within the cooling system.

With the present invention, in order to control the temperature of the engine, advantage is taken of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C.—for example at approximately 119° C. (corresponding to a pressure of approximately 1.9 Atmospheres).

On the other hand, during high speed cruising, it is further possible by increasing the flow of cooling air passing over the radiator, to increase the rate of condensation within the radiator to a level which reduces the pressure prevailing in the cooling system below atmospheric and thus induce the situation wherein the coolant boils at temperatures in the order of 80° to 90° C.

Figure 8:
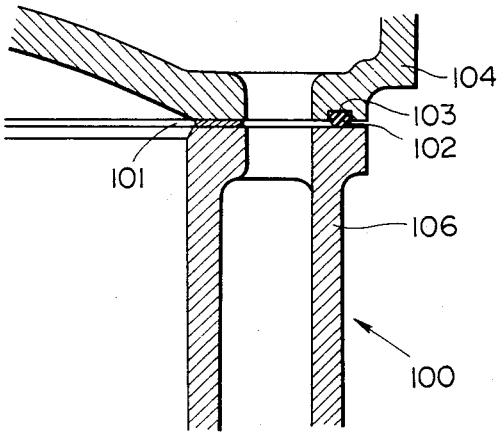
FIG. 8 is a cross sectional view of a cylinder head and cylinder block of a reciprocating piston internal combustion engine showing the provision of a seal which characterizes the present invention.

However, under these sub-atmospheric conditions, air tends to be inducted into the system. In reciprocating piston type engines, leakage is particularly prevalent at the interface defined between the cylinder head and cylinder block. Accordingly, with such engines it is preferred to modify the head gasket 101 and provide a seal, such as shown in FIG. 8, in the form of an "O" ring 102 having an undistorted diameter which is greater than the combined thickness of the head gasket 101 and depth of the groove 103 in which is it received. With this arrangement, when the cylinder head 104 is tightened down on the cylinder block 106 to compress the cylinder head gasket 101 therebetween, the "O" ring 102 is compressed establishing an air tight seal.

Figure 9:
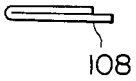
FIGS. 9 and 10 show alternate seal arrangements which may be used with the engine shown in FIG. 8.
Figure 10:
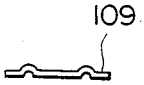

FIGS. 9 and 10, shown possible alternate seal arrangements. In FIG. 9 the seal 108 takes the form of a gasket similar to the head gasket but which is folded back to double its thickness. In FIG. 10 the seal 109 takes the form of a gasket formed with two or more ridges which establish line contact with the cylinder head. If desired the latter two examples may be formed integrally with the main body of the head gasket.

Figure 11:
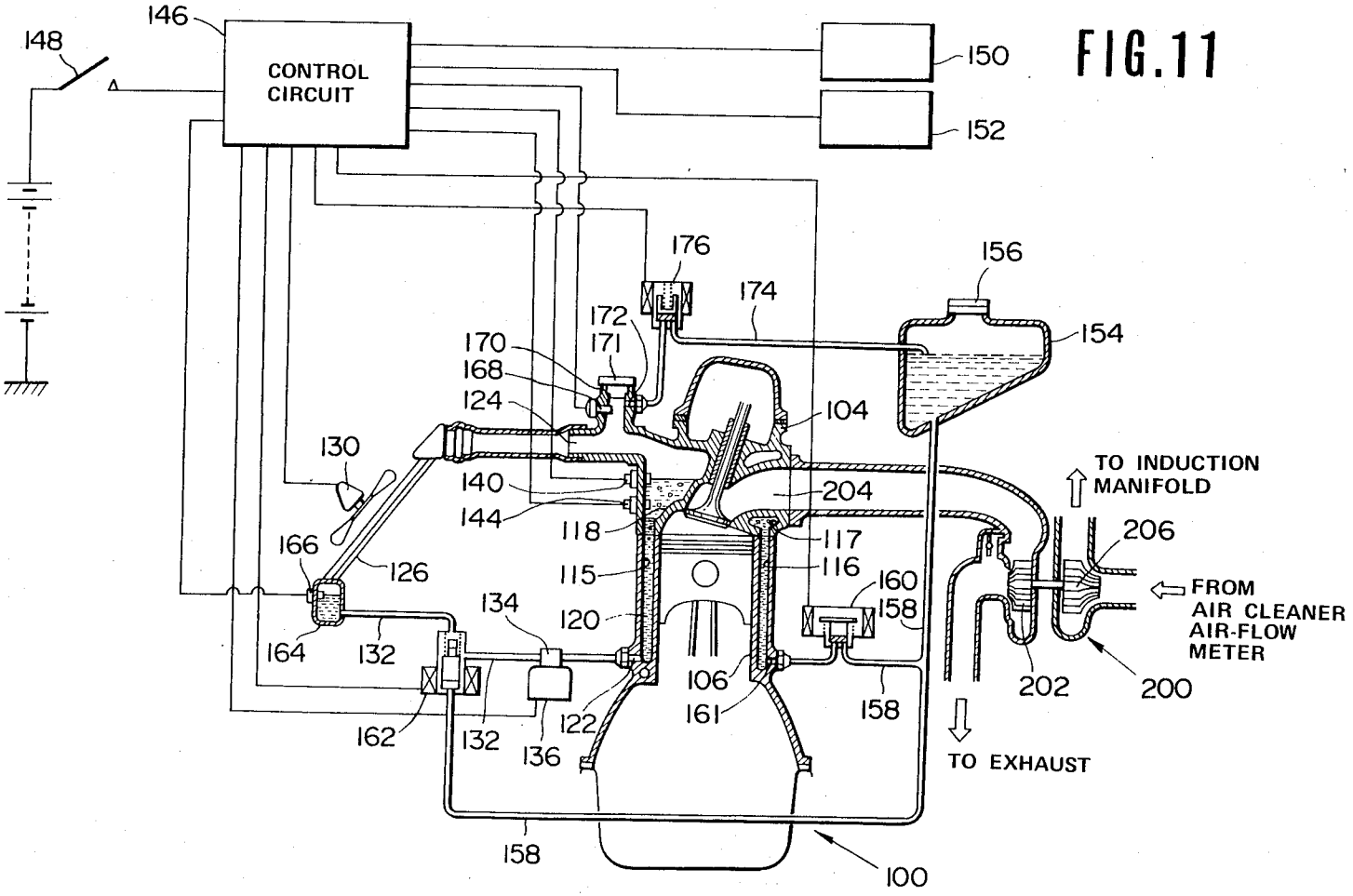
FIG. 11 shows an engine system incorporating a cooling system according to the present invention.

FIG. 11 shows an engine system incorporating the present invention. In this arrangement an internal combustion engine 100 includes a cylinder block 106 on which a cylinder head 104 is detachably secured. The cylinder head and cylinder block include suitable cavities 115–118 which define a coolant jacket 120 about the heated portions of the cylinder head and block. In this embodiment, coolant is introduced into the coolant jacket 120 through a port 122 formed in the cylinder block 106. As shown, this port 122 communicates with a lower level of the coolant jacket 120. Finally communicating with a vapor discharge port 124 of the cylinder head 104 is a radiator or heat exchanger 126. It should be noted that the interior of this radiator is maintained essentially empty of liquid coolant during normal engine operation so as to maximize the surface area available for condensing coolant vapor (via heat exchange with the ambient atmosphere) and that the cooling system as a whole (viz., coolant jacket, radiator etc.) is hermetically sealed when the engine is warmed up and running.

If deemed advantageous a mesh screen or like separator (not shown) can be disposed in the vapor discharge port of the cylinder head so as to minimize the transfer of liquid coolant which tends to froth during boiling, to the radiator 126.

Located suitably adjacent the radiator 126 is a electrically driven fan 130. Disposed in a coolant return conduit 132 is a return pump 134. In this embodiment, the pump is driven by an electric motor 136.

In order to control the level of coolant in the coolant jacket, a level sensor 140 is disposed as shown. It will be noted that this sensor is located at a level higher than that of the combustion chambers, exhaust ports and valves (structure subject to high heat flux) so as to maintain same securely immersed in coolant and therefore attenuate engine knocking and the like due to the formation of localized zones of abnormally high temperature or "hot spots".

Located below the level sensor 140 so as to be immersed in the liquid coolant is a temperature sensor 144. The output of the level sensor 140 and the temperature sensor 144 are fed to a control circuit 146 or modulator which is suitably connected with a source of EMF upon closure of a switch 148. This switch of course may advantageously be arranged to be simultaneously closed with the ignition switch of the engine (not shown).

The control circuit 146 further receives an input from the engine distributor 150 (or like device) indicative of engine speed and an input from a load sensing device 152 such as a throttle valve position sensor. It will be noted that as an alternative to throttle position, the output of an air flow meter or an induction vacuum sensor may used to indicate load.

In this embodiment the engine is equipped with a tubocharger 200. This turbocharger unit, as shown, includes an impeller 202 rotatably driven by the hot exhaust gases discharged from the combustion chamber via the exhaust port 204. The compressor 206 of the turbocharger is arranged to induct air via an air cleaner and air flow meter, compress and discharge same into the induction manifold of the engine via an intercooler if desired (neither shown).

A coolant reservoir 154 is located beside the engine proper as shown. In this embodiment the reservoir 154 is arranged at a level higher than the engine for reasons which will become apparent hereinlater. An air permeable cap 156 is used to close the reservoir in a manner that atmospheric pressure continuously prevails therein.

The reservoir 154 fluidly communicates with the engine coolant jacket 120 via conduit 158 and an electromagnetic valve 160. This valve 160 is arranged to be closed when energized and to communicate with a port 161 formed in a lower portion of the coolant jacket.

A second electromagnetic valve 162 is disposed in the return conduit 132 and arranged to establish fluid communication between the pump 134 and a small collection tank or reservoir 164 provided at the bottom of the radiator 126 when de-energized and establish fluid communication between the pump 134 and the reservoir 154 via conduit 158, when energized.

A second coolant level sensor 166 is disposed in the collection tank 164.

A third coolant level sensor 168 is disposed in a riser-like portion 170 of the cylinder head 104. This sensor 168 is located immediately below a cap 171 which hermetically closes the riser 170. Located immediately adjacent and/or slightly above the third level sensor 168 is a "purge" port 172. This port, as shown, communicates with the reservoir 154 via an overflow conduit 174. A normally closed third electromagnetic valve 176 is disposed in the overflow conduit 174. This valve is opened when energized.

Seals of the nature disclosed hereinbefore are used to seal the interfaces defined between the cylinder head 104 and cylinder block 106 and other sites where air is apt to leak into the system upon a negative pressure prevailing therein. For simplicity of illustration these seals are not shown in FIG. 11.

Prior to use the cooling system is filled to the brim with coolant (for example water or a mixture of water and antifreeze or the like) and the cap 171 securely set in place to seal the system. A suitable quantity of coolant is also poured into the reservoir 154. The engine is started. Under these conditions as the system is completely filled with coolant very little heat can be removed from the engine and the coolant quickly warms. Before reaching a predetermined temperature (for example 35° C.) any air in the system, such as that dissolved in the coolant per se, tends to be forced out of solution by the heating and rise to collect in the riser portion 170. At this time, as the level of coolant falls below that of the level sensor 168, the control circuit energizes the electromagnetic valves 160, 162 & 176 and the pump 134. This energization may be continued for a predetermined short period of time (e.g. three or four seconds) after the level sensor 168 indicates the level having risen thereto. This procedure closes valve 160, moves valve 162 to the position wherein communication is established between the pump 134 and the reservoir 154 and opens the overflow conduit 174 (via opening of the third valve 176). Accordingly, the pump 134 draws coolant from the reservoir 154 via conduit 158 and forces same into the system overfilling same. The excess coolant displaces the air or other non-condensible matter out through the overflow conduit 174. Upon the previously mentioned predetermined temperature being exceeded, this "purge" mode is terminated and the valves 160, 162 & 176 and pump 134 are de-energized.

Subsequently, the coolant temperature continues to rise and begins generating vapor pressure within the system. This pressure displaces coolant back out through valve 160 (now de-energized) to the reservoir 154 until the first level sensor 140 is uncovered. This induces the energization of the pump 134 which inducts coolant from the radiator 126 and discharges same into the cylinder block 106 through port 122. This tends to empty the radiator 126 while maintaining the level of the coolant within the cylinder block at that of the first level sensor 140. This procedure is continued until the level of coolant in the radiator 126 falls to that of the second level sensor 166, whereupon the valve 160 is energized and system placed in a "closed" condition.

In order to control the temperature within the coolant jacket the control circuit 146 selectively energizes the motor of the fan 130 in a manner to induce a rate of condensation in the radiator which controls the pressure prevailing in the cooling system to a level whereat the coolant boils at a temperature suited to the particular load and/or engine speed conditions of the engine.

Upon stoppage of the engine 100, valve 160 is de-energized and, as the vapor pressure within the radiator and cylinder head falls due to the cooling of the engine and the condensation of the steam therein, coolant flows into the system from the reservoir 154 via the valve 160 under the influence of atmospheric pressure acting on the surface of the coolant in the reservoir and under the influence of gravity (it being noted that the reservoir is located slightly above the engine per se) until the system is filled.

Filling of the cooling system in this manner obviates any tendancy for sub-atmospheric conditions to prevail and for any air to be inducted.

Upon the engine being started again, if the temperature has fallen below 35° C. (by way of example only) the previously disclosed "purge" mode will be initiated should the third level sensor indicate that the riser portion is not completely filled with coolant.

Figure 12:
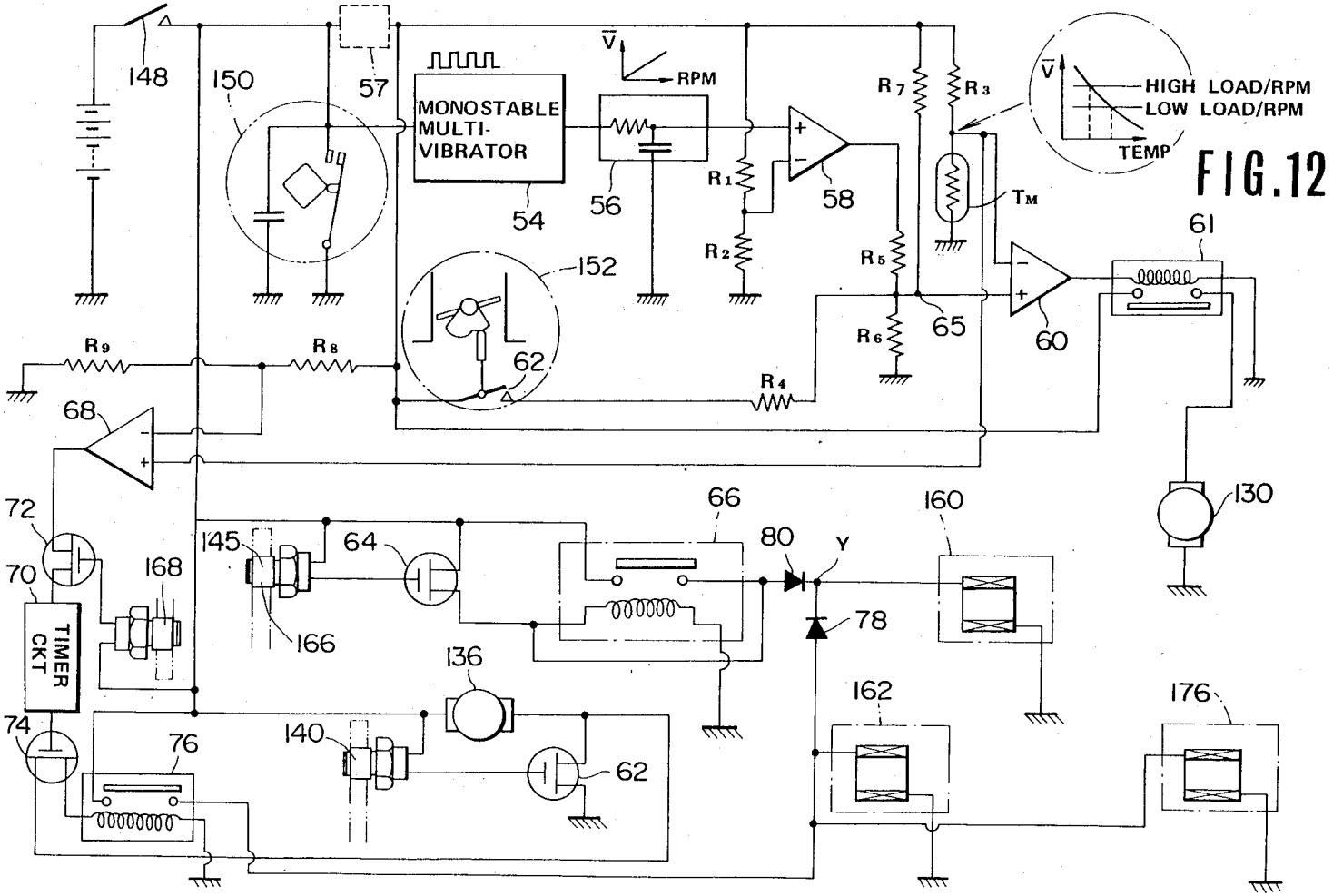
FIG. 12 shows a circuit arrangement suitable for controlling the valves, fan and pump of the arrangement shown in FIG. 11.
Figure 13:
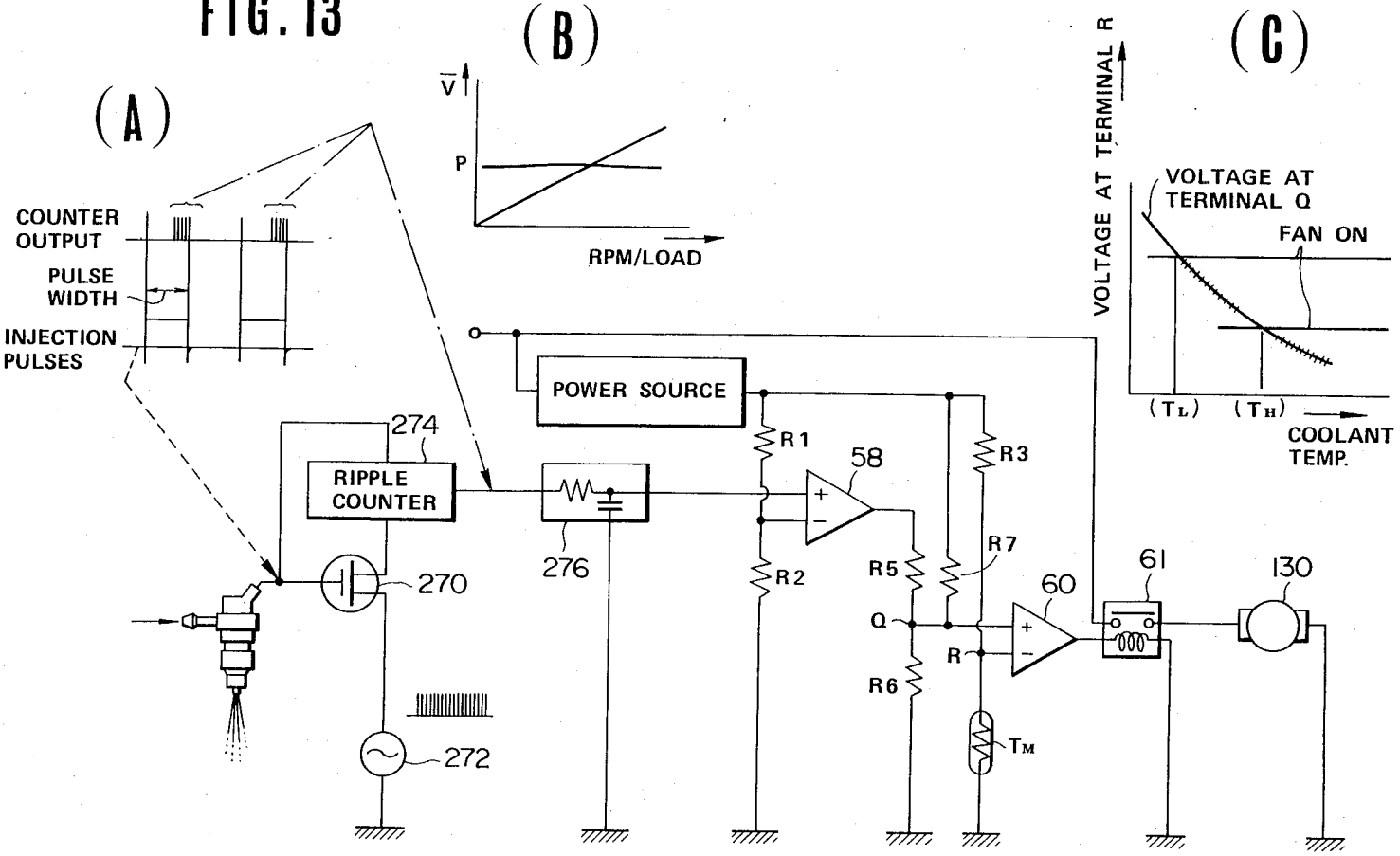
FIGS. 13*a–c* show a second circuit suitable for use with fuel injected engines.

FIG. 12 shows a circuit suitable for controlling the valves 160, 162 & 176, pump 134 and fan 130 shown in FIG. 11.

In this circuit arrangement the distributor 150 of the engine ignition system is connected with the source of EMF via the switch 148. A monostable multivibrator 54 is connected in series between the distributor 150 and a smoothing circuit 56. A DC—DC converter 57 is arranged, as shown in broken line, to ensure a supply of constant voltage. A first voltage divider consisting of resistors R1 and R2 provides a comparator 58 with a reference voltage at its inverting input (−) thereof while the non-inverting input (+) of said comparator receives the output of the smoothing circuit 56. A second voltage dividing arrangement consisting of a resistor R3 and a thermistor $T_M$ (viz., the heart of the temperature sensor 144) applies a variable voltage to a second comparator 60 which also receives a signal from a cam operated throttle switch 62 via a resistor arrangement including resistors R4, R5, R6 and R7 connected as shown. The output of the comparator 60 is applied to the fan 130 via a relay 61 for energizing same.

The circuit further includes a transistor 62 which acts a switch upon receiving an output from the level sensor 140 to establish a circuit between the source of EMF and ground. As a safety measure, an inverter or the like (not shown) may be interposed between the level sensor 140 and the transistor 62, and the level sensor adapted to produce an output when immersed in coolant. With this arrangement should the level sensor malfunction, the lack of output therefrom causes the transistor 62 to be continuously rendered conductive and the pump 136 continually energized to ensure that an adequate amount of coolant is maintained in the coolant jacket.

In order to achieve the desired control of valve 160, level sensor 166 is circuited via transistor 64 with a self-energizing relay 66 in a manner that, until the level of the coolant in the radiator 126 is forced down to the level of the level sensor 166, the relay is not closed and the solenoid of the valve 160 not energized, whereby the desired amount of coolant contained in the radiator 126 and coolant jacket can be appropriately adjusted. Opening of the switch 148 de-energizes the solenoid of the valve 160 and opens the self energizing relay 66.

As will be appreciated, with the circuit thus far disclosed, depending on the load and engine speed, the temperature of the coolant in the coolant jacket 120 will be adjusted in a manner that at low engine speeds and loads the voltage appearing at the inverting terminal of the comparator will be compared with the voltage appearing on the non-inverting terminal thereof and the fan 130 suitably engergized to maintain a high temperature under so called "urban cruising" conditions and lowered at high load/speed operation. Further, upon stoppage of the motor, the coolant jacket 120 and radiator 126 will be completely filled with coolant to exclude the possibility of air contamination.

This circuit further includes a comparator 68 which receives the output of second voltage divider (R3, $T_M$) on its non-inverting terminal (+) and a reference voltage from a voltage divider consisting of resistors R8, R9 on its inverting one (−). The resistances of the resistors R8, R9 are selected to provide a voltage representative of the predetermined temperature (viz., 35° C.).

The output of this comparator 68 is fed to a timer circuit 70 via transistor 72. The base of this transistor 72 is connected with the third level sensor 168 so that upon the level falling below same, the sensor 168 outputs a signal rendering the transistor 72 conductive. The timer circuit 70 may be arranged to maintain a high level output for a short period of time after the high level output of the comparator 68 disappears (3–4 seconds for example). The output of the timer circuit 70 is fed to the base of a transistor 74 which as shown serves a switch for energizing relay 76. This relay 76 upon being closed by a current passing through the coil thereof (via the pump motor 136 and the transistor 74), supplies current to the solenoids of valves 162, 176. So as to temporarily close valve 160, the relay 76 is connected to the solenoid of valve 160 through a diode 78. To prevent unwanted closure of the relay 66, a second diode 80 is disposed as shown, to prevent current from flowing from terminal Y to ground through the coil of relay 66.

As will be appreciated if the temperature of the coolant as sensed by the termister Tm is below 35° C. and the level of coolant is below the third level sensor 168, then valves 160, 162 & 168 and the pump motor 136 will be energized.

If desired the timer circuit 70 may be omitted.

FIG. 8 shows a second circuit arrangement which may be employed in the case the engine is equipped with a fuel injection system. This arrangement does not include the level sensors and associated elements for simplicity of illustration.

This alternative arrangement differs from that shown in FIG. 7 by the inclusion of a transistor 270, a clock circuit 272, a ripple counter 274 and a smoothing circuit 276, all connected as shown. Due to the fact that the frequency of injection control pulses varies with engine speed and the voltage output of the smoothing circuit 276 varies with pulse width as well as the frequency of injection, it is possible to use this arrangement in place of both of the throttle switch 62 and distributor 150 as will be appreciated by those skilled in the art. For the sake of simplicity the level sensors 140, 166 & 168 and associated circuitry have been omitted from this figure as previously mentioned.

More specifically, the operation of the FIG. 7 circuit is such that when the injector driving signal is applied to the base of the transistor 270 and the output of the clock generator 272 is fed to the ripple counter 274. The characteristics of the ripple counter 274 are so selected that it outputs a carry only when the width of the injection pulses are greater than a predetermined value (viz., indicative of a load in excess of a predetermined value). The injection driving pulses are applied to the reset terminal of the counter 274. Upon the width of the injection pulse exceeding said predetermined value, the ripple counter 274 will output a carry (a number of clock pulses) which varies with the width of the pulse in excess of the predetermined value, as will be clear from insert "A". The output of the smoothing circuit 276 accordingly increases with engine speed and load (pulse width). The output of the smoothing circuit 276 is applied to the non-inverting terminal (+) of the comparator 58 which receives a fixed reference voltage from the voltage divider defined by resistors R1 and R2 on its inverting one (−). Accordingly, upon the voltage level of the smoothing circuit 276 output exceeding that provided by the R1–R2 voltage divider (see voltage P in insert "B"), the comparator produces an output to terminal Q.

The voltage appearing at terminal R decreases with increase of coolant temperature due to the inherent characteristics of the thermistor $T_M$. Accordingly, if the voltage appearing on terminal R is at a high level due to the engine operating at high load/speed conditions, the fan 130 will be energized to maintain a low coolant temperature ($T_L$) as will be clear from insert "C". On the other hand, should the engine be operating under the so called "urban cruising" conditions, the voltage appearing on terminal Q will be low due to absence of an output from the comparator 58 and the fan 130 will be operated in a manner to reduce the rate of condensation in the radiator 126 and raise the temperature of the coolant to a high level ($T_H$).

A microprocessor may be used in place of the above disclosed circuits. This processor of course may also be used for other engine control functions as well known in the art of engine control. The program via which the embodiment shown in FIG. 11 can be controlled is deemed relatively simple and well within the perview of one skilled in the art of computer programming and thus will not be discussed for brevity.

It will be noted that, if deemed advantageous, the temperature of the engine coolant may be varied continuously with change in load and/or engine speed as different form the stepwise control disclosed hereinbefore.

Figure 14:
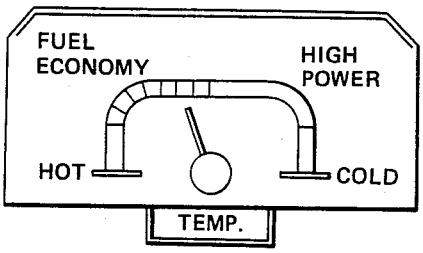
FIG. 14 shows a gauge which may be disposed in view of the vehicle driver and which indicates the particular mode of operation the engine is undergoing.
Figure 15:
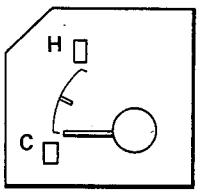
FIG. 15 shows a gauge which can be used in conjunction with the present invention to indicate the engine coolant temperature.

FIGS. 14 and 15 shows different types of gauges which may be placed in instrument cluster on the instrument panel of the vehicle. With this arrangement should a malfunction occur in the system, the driver may be able to discern same given the temperature conditions of the engine and the mode in the vehicle is being controlled.

It will be appreciated that a pressure sensor may be used in place of the disclosed temperature sensor 144 if desired. In this instance the pressure sensor would be disposed at a level above that of the first level sensor 140.

With the present invention, a notable improvement in turbocharged engines may be realized. That is to say, as the temperature of the engine coolant is raised to 120° C. (by way of example) during relatively light load operation, the temperature of the exhaust gases which power the turbocharger is higher than with conventional cooling systems and thus impart more energy thereto. Hence, at low loads and speeds the efficiency and rate of acceleration of the turbocharger are increased. On the other hand, during high load operation, as it is possible to remove much more heat than with the prior art arrangements and the temperature of the engine is also notably lower, it is possible to operate the engine under full supercharge boost with only half the ignition retardation required by the prior art. Accordingly, this, in combination with the inherently increased charging efficiency provided under such circumstances, markedly enhances engine performance.

What is claimed is:

1. In an internal combustion engine having a combustion chamber:

a radiator;

a coolant jacket in which coolant is boiled and the vapor produced fed to said radiator;

a first sensor for sensing a first engine operation parameter said first engine operation parameter being other than the temperature or pressure in either of said coolant jacket or said radiator;

a device responsive to said first sensor for varying the rate of condensation of said vapor in said radiator, said device being responsive to said first sensor in a manner to selectively control the temperature of the coolant in said coolant jacket toward one of a first and second levels; and means for preventing air entering said coolant jacket when sub-atmospheric pressures prevail therein;

wherein said engine includes a cylinder block and a cylinder head detachably mounted on said cylinder block to define said combustion chamber;

said coolant jacket is defined by cavities formed in said cylinder head and said cylinder block, and said preventing means takes the form of a seal disposed between said cylinder head and cylinder block, said seal preventing the invasion of air between said cylinder head and said cylinder block into said cavities when said sub-atmospheric pressure prevails therein.

2. In an internal combustion engine having a combustion chamber:

a radiator;

a coolant jacket in which coolant is boiled and the vapor produced fed to said radiator;

a first sensor for sensing a first engine operation parameter;

a level sensor disposed at the bottom of said radiator;

a device responsive to said first sensor for varying the rate of condensation of said vapor in said radiator; and means for excluding air from said coolant jacket at all times, said excluding means including seals for preventing external atmospheric air from leaking into said coolant jacket when sub-atmospheric conditions prevail therein;

wherein said excluding means further comprises:

a reservoir in which coolant is stored; and a control arrangement for establishing fluid communication between one of said radiator and said coolant jacket when one of the temperature and pressure within said coolant jacket is below a predetermined temperature or pressure, said control arrangement comprising a first valve for controlling the fluid communication between said reservoir and said one of said radiator and said coolant jacket, said control arrangement being responsive to the starting of said engine and to the output of said level sensor for closing said first valve.

3. An internal combustion engine as claimed in claim 2, further comprising:

a third level sensor disposed in one of said coolant jacket and said radiator and located at a level whereat it is immersed in liquid coolant only when said coolant jacket and said radiator are completely filled with liquid coolant;

a second valve which controls fluid communication between said reservoir and one of said coolant jacket and radiator, said second valve being disposed in an overflow conduit which leads from a location in close proximity of said third level sensor to said reservoir; and a third valve disposed in a supply conduit which leads from said reservoir to said return conduit, said supply conduit communicating with said return conduit at a location upstream of said pump;

said control arrangement being arranged to open and close said first, second and third valves and operate said pump in response to the outputs of said third level sensor and said second sensor in a manner to fill said coolant jacket and radiator with liquid coolant from said reservoir until said third sensor is immersed therein and thus displace any noncondensible matter out through said overflow conduit and said second valve to said reservoir, when the temperature within said coolant jacket is at a level at which said radiator and coolant jacket should be completely filled with liquid coolant.

4. In an internal combustion engine having a combustion chamber:

a cooling circuit comprising:

a radiator;

a coolant jacket in which coolant is boiled and the vapor produced fed to said radiator;

a first sensor for sensing a first engine operation parameter;

a device responsive to said first sensor for varying the rate of condensation of said vapor in said radiator;

sealing means for preventing air entering said coolant jacket when sub-atmospheric pressures prevail therein;

a reservoir in which coolant is stored;

a control arrangement for establishing fluid communication between said reservoir and said cooling circuit when one of the temperature and pressure within said coolant jacket is below a predetermined temperature or pressure; and a level sensor disposed at the bottom of said radiator, said control arrangement being responsive to the starting of said engine and to the output of said level sensor for selectively cutting off communication between said reservoir and said cooling circuit.

5. An internal combustion engine as claimed in claim 4, further comprising:

a third level sensor disposed in one of said coolant jacket and said radiator and located at a level whereat it is immersed in liquid coolant only when said coolant jacket and said radiator are completely filled with liquid coolant;

a second valve which controls fluid communication between said reservoir and one of said coolant jacket and radiator, said second valve being disposed in an overflow conduit which leads from a location in close proximity of said third level sensor to said reservoir; and a third valve disposed in a supply conduit which leads from said reservoir to said return conduit, said supply conduit communicating with said return conduit at a location upstream of said pump;

said control arrangement being arranged to open and close said first, second and third valves and operate said pump in response to the outputs of said third level sensor and said second sensor in a manner to fill said coolant jacket and radiator with liquid coolant from said reservoir until said third sensor is immersed therein and thus displace any non-condensible matter out through said overflow conduit and said second valve to said reservoir, when the temperature within said coolant jacket is at a level at which said radiator and coolant jacket should be completely filled with liquid coolant.

6. In an internal combustion engine having a combustion chamber:

a radiator;

a coolant jacket in which coolant is boiled and the vapor produced fed to said radiator;

a first sensor located outside of said radiator and coolant jacket for sensing an engine load;

a device responsive to said first sensor for varying the rate of condensation of said vapor in said radiator; and means for preventing air entering said coolant jacket when sub-atmospheric pressures prevail therein; and wherein said device induces a first rate of condensation in said radiator which maintains the temperature of said coolant in said coolant jacket below a predetermined temperature when said engine load sensor indicates the load on said engine is above a predetermined level and which induces a second rate of condensation which maintains the temperature of said coolant in said coolant jacket above said predetermined temperature when said engine load sensor indicates the load on said engine is below said predetermined level.

7. In an internal combustion engine having a combustion chamber:

a cooling circuit comprising:

a radiator;

a coolant jacket in which coolant is boiled and the vapor produced by the boiling fed to said radiator for condensation therein;

a first sensor for sensing the load on said engine;

a second sensor disposed in said coolant jacket for sensing the temperature of the coolant therein;

a device responsive to said first and second sensors for varying the rate of condensation in said radiator in a manner to induce a first rate of condensation in said radiator which maintains the temperature of the coolant in said coolant jacket below a predetermined level when said first sensor indicates that the load on said engine is above a predetermined level and to induce a second rate of condensation which maintains the temperature of the coolant in said coolant jacket above said predetermined level when said first sensor indicates that the load on said engine is below said predetermined level; and means for excluding air from said coolant jacket at all times, said excluding means including seals for preventing external atmospheric air from leaking into said coolant jacket when sub-atmospheric pressures prevail therein.

8. A internal combustion engine as claimed in claim 7, further comprising:

a level sensor disposed in said coolant jacket at a level higher than said combustion chamber;

a pump responsive to said level sensor for returning condensed coolant from said radiator to said coolant jacket in a manner which maintains the level of liquid coolant in said coolant jacket at the level of said level sensor.

9. An internal combustion engine as claimed in claim 7 wherein said excluding means further comprises:

a reservoir in which coolant is stored, said reservoir being discrete from said cooling circuit; and a control arrangement for establishing fluid communication between said cooling circuit when one of the temperature and pressure within said cooling circuit is below a predetermined temperature or pressure.

10. An internal combustion engine as claimed in claim 9, wherein said control arrangement comprises a first valve for controlling the fluid communication between said reservoir and said one of said radiator and said coolant jacket.

11. An internal combustion engine as claimed in claim 7, wherein:

said engine includes a cylinder block and a cylinder head detachably mounted on said cylinder block to define said combustion chamber;

said coolant jacket is defined by cavities formed in said cylinder head and said cylinder block, and said preventing means takes the form of a seal disposed between said cylinder head and cylinder block, said seal preventing the invasion of air between said cylinder head and said cylinder block into said cavities when said sub-atmospheric pressure prevails therein.

12. An internal combustion engine as claimed in claim 11, wherein said seal takes the form of an "O" ring disposed in a groove formed in one of said cylinder head and cylinder block, said "O" ring having a diameter greater than the combined depth of said groove and the thickness of a head gasket disposed between said cylinder head and said cylinder block which prevents exhaust gases escaping from said combustion chamber via the interface defined between said cylinder head and said cylinder block.

13. An internal combustion engine as claimed in claim 7, further comprising: a turbocharger, said turbocharger being driven by the hot exhaust gases exhausted from said combustion chamber and arranged to supply air under pressure to said combustion chamber via an induction manifold.

14. An internal combustion engine as claimed in claim 7, wherein said first parameter sensing sensor senses engine load.

15. An internal combustion engine as claimed in claim 7, further comprising a third sensor which senses the engine speed of said engine.

16. An internal combustion engine as claimed in claim 7, wherein said temperature sensor is immersed in the liquid coolant in said coolant jacket.

17. In an internal combustion engine having a combustion chamber:

a cooling circuit comprising:

a radiator;

a coolant jacket in which coolant is boiled and the vapor produced by the boiling fed to said radiator for condensation therein, said coolant jacket including structural elements which are fastened together in a manner to define an interface therebetween;

a first sensor for sensing the load on said engine;

a second sensor disposed in said coolant jacket for sensing the temperature of the coolant therein;

a device responsive to said first and second sensors for varying the rate of condensation in said radiator in a manner which induces a first rate of condensation in said radiator which maintains the temperature of the coolant in said coolant jacket below a predetermined level when said first sensor indicates that the load on said engine is above a predetermined level, and which induces a second rate of condensation which maintains the temperature of the coolant in said coolant jacket above said predetermined level when said first sensor indicates that the load on said engine is below said predetermined level; and gasket means for preventing air from leaking through said interface and entering said cooling circuit when sub-atmospheric pressures prevail in said cooling circuit.

18. An internal combustion engine as claimed in claim 17, wherein:

said engine includes a cylinder block and a cylinder head attached to said cylinder block in a manner to define a combustion chamber;

said coolant jacket is defined by cavities formed in said cylinder head and said cylinder block;

said structural elements take the form of said cylinder head and said cylinder block and said interface is defined between said cylinder head and said cylinder block;

said engine includes a gasket disposed between said cylinder head and cylinder block and inboard of said cavities, said gasket preventing coolant from entering said combustion chamber and gaseous combustion products escaping from said combustion chamber into said cavities; and said gasket means for preventing atmospheric air leakage takes the form of a seal disposed between said cylinder head and said cylinder block outboard of said cavities for preventing the invasion of air from outside of said engine into said cavities when a sub-atmospheric pressure prevails within said cooling circuit.

* * * * *